US005223815A

United States Patent [19]

Rosenthal et al.

[11] Patent Number: 5,223,815

[45] Date of Patent: Jun. 29, 1993

[54] PORTABLE ANTI-THEFT DEVICE

[75] Inventors: Edward A. Rosenthal, Oakland; Daniel L. Murphy, Palo Alto, both of Calif.

[73] Assignee: Bistar Electronics Inc., Belmont, Calif.

[21] Appl. No.: 835

[22] Filed: Jan. 5, 1993

Related U.S. Application Data

[63] Continuation of Ser. No. 700,560, May 15, 1991, abandoned.

[51] Int. Cl.[5] ..... G08B 1/08; G08B 25/08

[52] U.S. Cl. ..... 340/539; 340/531; 340/571; 340/572; 340/573; 455/9; 455/229

[58] Field of Search ..... 340/539, 572, 573, 531, 340/568, 571, 692; 455/9, 67.1, 67.7, 134, 229, 227, 226.2

[56] References Cited

U.S. PATENT DOCUMENTS 4,593,273 6/1986 Narcisse ..... 340/539
4,598,272 7/1986 Cox ..... 340/539
4,785,291 11/1988 Hawthorne ..... 340/539
4,871,997 10/1989 Adriaenssens et al. ..... 340/539
4,897,630 1/1990 Nykerk ..... 340/539

*Primary Examiner*—Donnie L. Crosland
*Attorney, Agent, or Firm*—Ware & Freidenrich

[57] ABSTRACT

A portable anti-theft system and method for sounding an alarm which is a speech synthesizer when a first portable unit and a second portable unit become separated by a predetermined distance is disclosed herein. The system comprises transmitter means in the first portable unit for transmitting a signal, receiver means in said second portable unit for receiving the signal transmitted by the transmitter means, signal strength determination means in communication with the receiver means for comparing the strength of the received signal with a predetermined signal comprising speech synthesizing means for making an announcement when the signal strength determination means has determined that the strength of the received signal is less that the predetermined signal strength value.

3 Claims, 3 Drawing Sheets

FIG. 3

PORTABLE ANTI-THEFT DEVICE

This is a continuation of application Ser. No. 07/700,560 filed May 15, 1991, abandoned.

FIELD OF THE INVENTION

This invention relates to an alarm system and method for generating an announcement with a speech synthesizer when portable first and second units become separated by a predetermined distance.

BACKGROUND OF THE INVENTION

There is a wide variety of systems used to trigger alarms under a multitude of circumstances. For example, car alarms sense vibration, house alarms sense motion and smoke alarms sense smoke. Often, alarms comprise at leas two units in communication with one another wherein one of the units generates some sort of alarm signal, be it by the detecting unit itself or by a remote unit separate from the detecting unit.

Other types of alarm systems include those which monitor the location of a person or article. Typically a first unit is a fixed unit. A second unit is typically a portable unit which is attached to a person or an article.

However, the systems of the prior art described herein do not provide for an alarm under the circumstances where, a traveling person who puts down his or her bag, looks up a moment too late to witness a thief making off with the bag. The traveling person, in this situation, has no way of calling attention to the thief as the theft is taking place nor knowing which direction the thief has gone in flight. Furthermore, the systems of the prior art do not speech synthesis means for announcing to the thief that the theft has been detected or other persons that the person carrying the stolen article is a thief.

The prior art includes a system, disclosed in U.S. Pat. No. 4,675,656 issued to Narcisse, which has a fixed first unit and a portable second unit, each transmitting and receiving signals. The portable second unit may include an alarm which may be triggered when the transmitter of the portable second unit sends a signal to the fixed first unit that a threshold condition has been reached.

Disclosed by Lemelson, issued U.S. Pat. No. 4,560,978, is a system including a fixed first unit and a portable second unit. The fixed first unit processes an alarm in the event that a threshold condition is reached by the portable second unit. This system also includes means for synthesizing speech at the second portable unit by receiving short wave transmissions generated at the fixed first unit. Such speech synthesis is not genera ed at the portable second unit.

Systems of the prior art may include least two portable units. For example, U.S. Pat. No. 4,598,272 issued to Cox, discloses two portable units, each transmitting and receiving signals. The system includes means for producing an audible alarm in the region of the second portable unit, such being activated at the first portable unit.

Furthermore, a system disclosed by Ayers, issued U.S. Pat. No. 4924,206, has, a first unit wired to an automobile and a portable second unit. The second unit transmits a signal to the first unit, and the first unit sends a signal to the second unit which is triggered by the absence of the second unit's transmitted signal. Each unit includes an alarm.

Each of the systems of the prior art described above provides for a monitor of a person's or article's distance from the first unit by electronic means. The goal achieved by the configurations of the prior art is that the first unit processes an alarm in the event that a threshold condition has been reached by the second unit.

The systems of the prior art described above do not provide for an alarm system having at least two portable units wherein the second portable unit activates and generates an alarm for indicating that the threshold condition has been reached. Moreover, the systems described above do not provide for the alarm of the second unit to include speech synthesizing means.

OBJECTS OF THE PRESENT INVENTION

It is an object of the present invention to provide for an alarm system having at least two portable units wherein the second portable unit specifically alarms a person or the equivalent in the immediate vicinity of the second portable unit that the threshold condition has been reached.

It is another object of the present invention to provide for the alarm processed by the second unit to include speech synthesizing means for announcing to the person at the second location that the threshold condition has been reached.

It is a further object of the present invention to provide for a system such that the first portable unit transmits a signal which is received by a plurality of second portable units.

It is yet another object of the present invention that the first portable unit transmits a coded signal such that it is intended to be processed by a particular second portable unit having signal discrimination means for triggering an alarm in the absence of the coded signal.

SUMMARY OF THE INVENTION

In accordance with these and other objects, the present invention includes a first portable unit having transmitter means and a second portable unit having receiver means, wherein signal strength determination means are in communication with the receiver means. When the strength of the received signal is less than a predetermined signal strength value, an alarm comprising a synthesized speech is announced by means located at the second portable unit.

In a preferred arrangement, the speech synthesizer provides an effective announcement to the thief which can cause the thief to release the article. Furthermore, bystanders may also be alerted that the thief is in possession of stolen property.

Also in a preferred arrangement, there are a plurality of second portable units such that a user may place receiver means with more than one article, such receiver means receiving the signal of a single first portable unit.

Moreover, in the preferred embodiment, the signal sent by the first portable unit is coded so a different system's second portable unit is not responsive to its signal. Therefore, in a crowded environment, many travelers, may have systems which do not interfere with each other's effectiveness.

BRIEF DESCRIPTION OF THE DRAWINGS

Other objects, and many of the intended advantages of the present invention, will be readily appreciated as the same becomes better understood by reference to the following detailed description when considered in connection with the accompanying drawing wherein.

DETAILED DESCRIPTION OF THE PREFERRED EMBODIMENT

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the claims.

Figure 1:
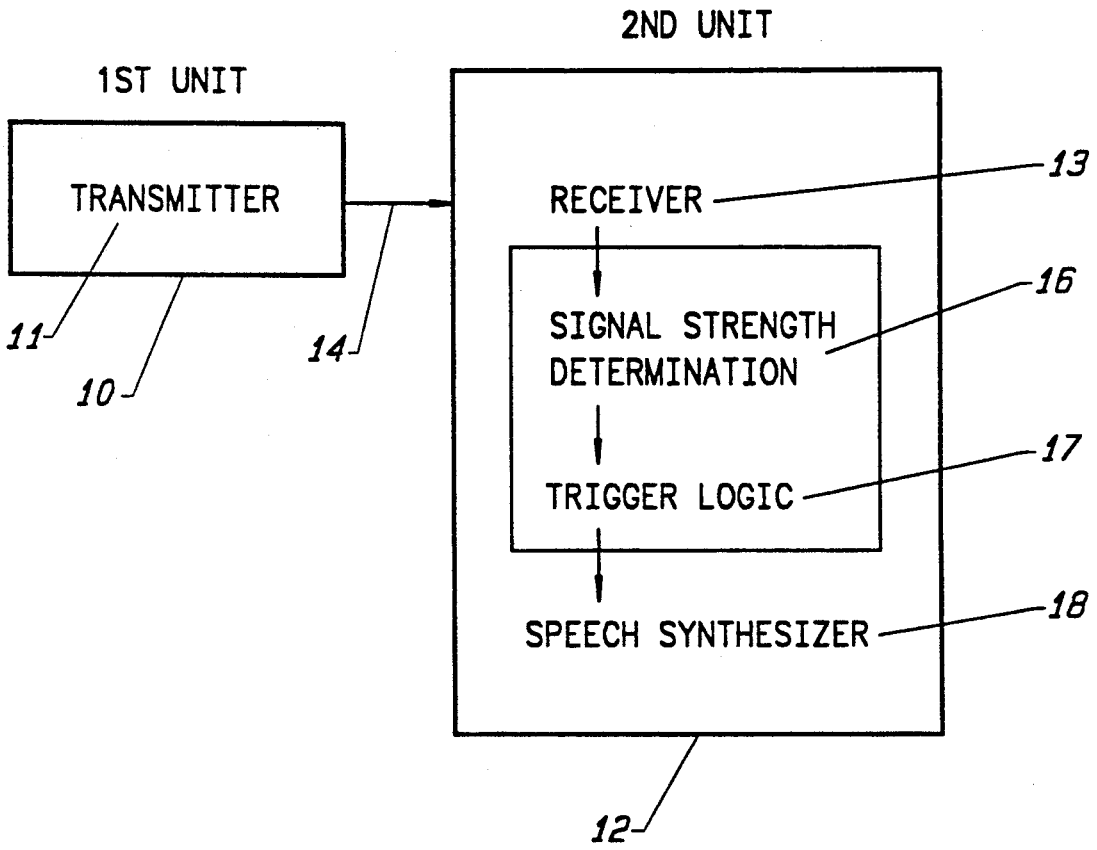
FIG. 1 shows an electronic flow chart diagram of the present invention.

FIG. 1 shows first portable unit 10 having a transmitter 11 and second portable unit 12 having a receiver 13. In accordance with the objects of the present invention detailed above, the signal 14 generated by the transmitter 11 need only be sensed by the receiver 13 at short range, preferably 1–100 feet. However, it may also be desirable that signal 14 be sensed by receiver 13 at long range, depending upon the circumstances of the use, which could include monitoring, for example, a child's location. The present invention may further include an adjustable transmission range which is adjustable according to the power used to drive the transmitter 11.

The signal 14 is preferably a radio frequency signal, but can also be another type, for example, an ultrasonic signal. FM is a particularly preferable carrier in that it can provide for reliable transmission of binary or digital pulses. FM transmitter integrated circuits and receiver integrated circuits are readily available from, for example, Motorola, Inc.

Once the signal 14 is received by receiver 13, signal strength determination means 16 determines whether the signal 14 is less than a predetermined reference signal strength value. Signal strength determination means 16 is a voltage comparator integrated circuit which is also readily available. Furthermore, a voltage comparator integrated circuit may, for example, include the trigger means 17 such that when the received signal drops below the predetermined reference signal strength voltage the comparator generates a voltage to energize speech synthesizer 18.

In accordance with the present invention, it is highly preferable to include speech synthesizer 18 although an alarm with a conventional alarm sound may also be effective. It is also preferable to construct the present invention with compact dimensions, as the user might like to keep first portable unit 10 in his or her front pants pocket. Moreover, the user might like to place a second portable unit in a camera case to prevent theft of the camera. Hence it is desirable to use integrated circuits for providing the required functions of the present invention.

Therefore, in accordance with the objects listed above, speech synthesizing means 18 is a speech synthesizing integrated circuit of the type available from, for example, Oki Semiconductor. Speech synthesizing means may also include the type obtainable from Ozen Sound Devices, Inc. which includes miniature record players. Other types of speech synthesizing means also include miniature tape players and miniature CD players.

The integrated circuit type of speech synthesizer is preferable in that it is by far the most compact of the aforementioned speech synthesizing means. Moreover, several languages may be programmed onto the integrated circuit, and dip switches may be provided which allow the user to configure the speech generated according to his or her environment. Furthermore, in the near future, integrated circuits may be programmable by the user. Presently, technology is advancing to provide gate mechanism in integrated circuits for customization of an integrated circuit by the user.

It also may be desirable to include an alarm comprising synthesized speech at the first unit to announce to the user that the threshold condition has been reached. Moreover, the present invention could also be used, for example, in household surveillance. In that case, the first portable unit is positioned at a distance from the second portable unit and the second portable unit is attached to a particular article. When the article and hence the second unit is moved and the threshold condition is reached, the first portable unit may activate a telephone dialing option or relay signal option to inform a party not within hearing range of the second portable unit that the threshold condition has been reached. Under other circumstances telephone dialing option may be activated by the second portable unit. Also, a flashing light such as a strobe could be activated by either the first or second portable unit. It could also trigger devices which create smoke or spray dye or odor.

Figure 2:
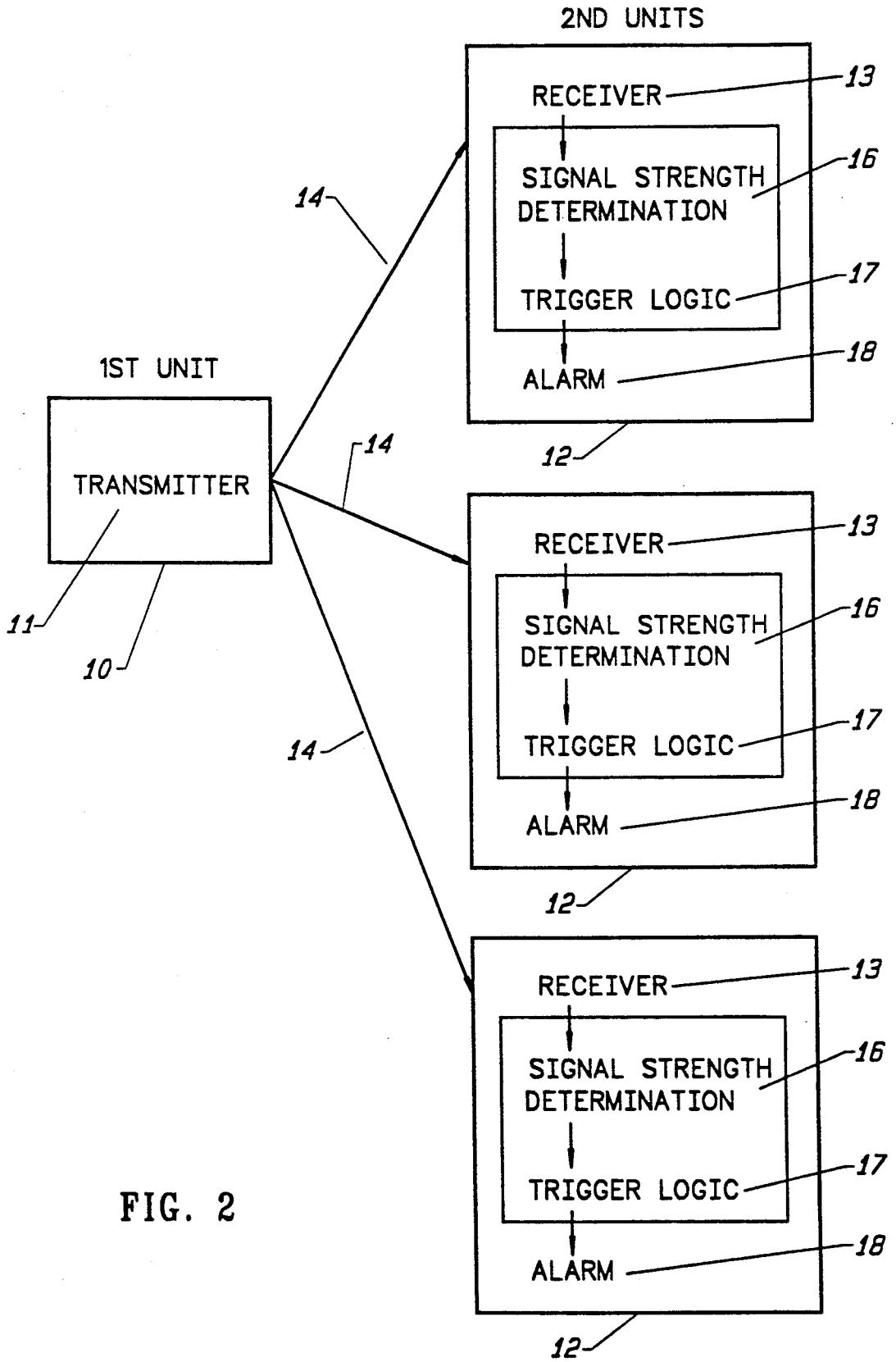
FIG. 2 shows a second electronic flow chart diagram of the present invention wherein there is a plurality of second portable units.

Turning to FIG. 2, the present invention is shown wherein there is a plurality of second portable units 12 each receiving signal 14 generated by transmitter 11 of first portable unit 10. This configuration allows a user of the present invention to monitor and prevent theft of several articles simultaneously, while only being required to carry one first portable unit 10 on his or her person.

Figure 3:
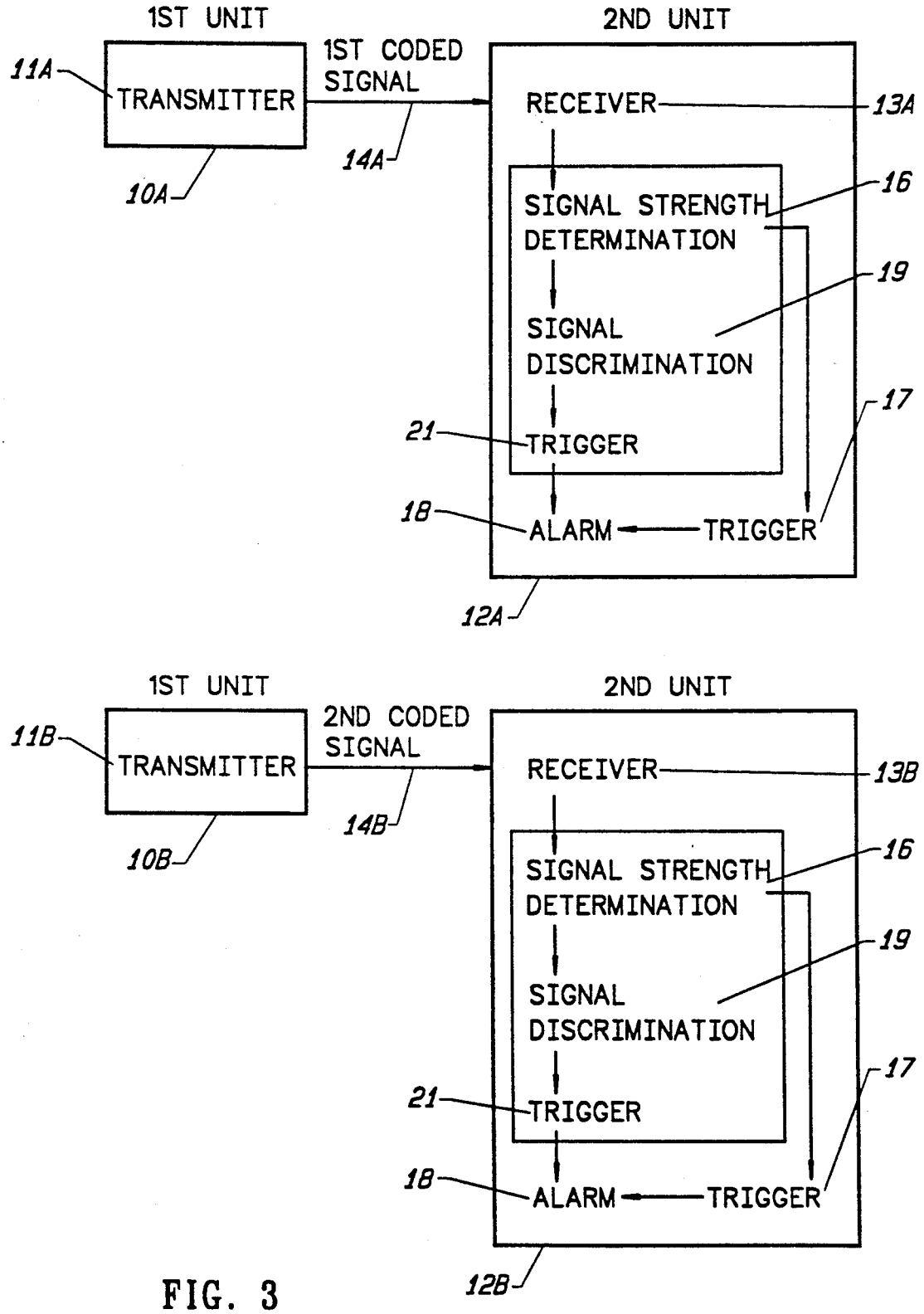
FIG. 3 shows a third electronic flow chart, diagram of the present invention wherein the first portable unit transmits a coded signal which is different from the signal transmitted by another first portable unit.

It is also desirable that the signal 14 generated from transmitter 10 is coded so that different systems used in close proximity to one another will not interfere with their respective effectiveness. Accordingly, FIG. 3 shows transmitted signals 14*a*and 14*b* which are coded in that first portable unit 10*a* and a different first portable unit 10*b* generate differently coded signals. The transmitter 11*a* of first portable unit 10*a* generates a signal 14*a* intended to be received by receiver 13*a* and transmitter 11*b* of first portable unit 10*b* generates a signal 14*b* intended to be received by receiver 13*b*.

Signal strength determination means 16 determines if there is a signal present. If not, alarm 18 is triggered by trigger logic 17. Signal discrimination means 19 then decodes the transmitted signal 14 and inquiries is the code is correct. If it is correct, the alarm 18 is not triggered. However, if the code is not correct, the alarm 18 is triggered by trigger logic 21. Signal discrimination means 19 is for example, a decoder integrated circuit or a transistor based circuit. Trigger logic 17 and trigger logic 21 may be incorporated as one logic circuit. Furthermore, the circuit configurations may be engineered differently than shown in FIGS. incorporated herein while providing the functions as recited in the claims.

The uses of the present invention also include preventing theft of unmonitored property. For example, on a building construction site, large amounts of expensive lumber frequently must be left unguarded. A second portable unit 12 of the present invention may be inconspicuously attached to a bundle of lumber and the first portable unit 10 may be located nearby. If a thief were to attempt to remove the lumber from the construction site, the alarm of the present invention may scare him or her into dropping the lumber in fear of being caught.

Clearly, the object of the present invention to provide for an alarm system having at least two portable units wherein the second portable unit specifically alarms a person or the equivalent in the immediate vicinity of the second portable unit that the threshold condition has been reached has been met. Moreover, the object of providing for the alarm processed by the second unit to include speech synthesizing means for announcing to the person at the second location that the threshold condition has been reached has also been met. Furthermore, the object of the present invention to provide for a system such that the first portable unit transmits a signal which is received by a plurality of second portable units has been met. Finally, the object of the present invention that the first portable unit transmits a coded signal and the second portable unit have signal discrimination means for triggering an alarm in the absence of the coded signal has also been met.

While the invention has been shown and described in what is presently conceived to be the most practical and preferred embodiment of the invention, it will become apparent to those of ordinary skill in the art that many modifications thereof may be made within the scope of the invention, which scope is to be accorded the broadest interpretation of the claims so as to encompass all equivalent structures and devices.

We claim:

1. An alarm system for use with a first portable unit and a second portable unit for sounding an alarm when said first portable unit and said second portable unit are separated by a predetermined distance, said system comprising:

said first and second portable units;

transmitter means in said first portable unit for transmitting a particular encoded signal, wherein said particular encoded signal contains transmitter identification information;

receiver means in said second portable unit for receiving said particular encoded signal transmitted by said transmitter means;

signal strength determination means in communication with said receiver means for comparing the strength of said particular encoded signal received from said transmitter means with a predetermined signal strength value;

signal discrimination means coupled to said receiver means for recognizing said particular encoded signal and distinguishing it from different encoded signals;

logic means for triggering an alarm signal when said signal strength determination means determines said signal strength of said particular encoded signal received from said transmitter means is less than said predetermined signal strength value; and speech synthesizing means for synthesizing speech and making an announcement when said logic means triggers said alarm signal.

2. A system as recited in claim 1 further comprising a plurality of second portable units wherein each unit has receiver means, signal strength determination means, signal discrimination means coupled to said receiver means for recognizing said particular encoded signal and distinguishing it from different encoded signals, and speech synthesizing means.

3. A method for sounding an alarm when a first portable unit and a second portable unit are separated by a predetermined distance, comprising the steps of:

transmitting a particular encoded signal from said first portable unit, said particular encoded signal having a strength value at said predetermined distance and wherein said particular encoded signal contains transmitter identification information;

receiving said particular encoded signal from said first portable unit in said second portable unit;

recognizing said particular encoded signal and distinguishing it from different encoded signals;

determining said strength of said particular encoded signal transmitted in said transmitting step; and synthesizing speech through a speech synthesizer and making an announcement when said particular encoded signal is recognized and when said strength of said particular encoded signal is less than predetermined signal strength value.

* * * * *